US008424875B2

(12) United States Patent
Heise et al.

(10) Patent No.: US 8,424,875 B2
(45) Date of Patent: Apr. 23, 2013

(54) DEVICE FOR DEPOSITING FOR A PRINTING MACHINE WITH A BLOWER SYSTEM

(75) Inventors: Jens U. Heise, Osterroenfeld (DE); Bernhard A. Linke, Felde (DE); Dieter Gritzuhn, Kiel (DE); Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 739 days.

(21) Appl. No.: 12/063,246

(22) PCT Filed: Aug. 3, 2006

(86) PCT No.: PCT/EP2006/007694

§ 371 (c)(1),
(2), (4) Date: Feb. 9, 2010

(87) PCT Pub. No.: WO2007/017182

PCT Pub. Date: Feb. 15, 2007

(65) Prior Publication Data

US 2011/0187038 A1 Aug. 4, 2011

(30) Foreign Application Priority Data

Aug. 11, 2005 (DE) ..... 10 2005 038 323
Aug. 18, 2005 (DE) ..... 10 2005 039 433

(51) Int. Cl.
*B65H 29/24* (2006.01)

(52) U.S. Cl.
USPC ..... 271/309; 271/176; 271/186

(58) Field of Classification Search ..... 271/176, 271/186, 309
See application file for complete search history.

(56) References Cited

U.S. PATENT DOCUMENTS

| | | | | |
|---|---|---|---|---|
| 2,262,236 | A | 11/1941 | Huck | |
| 2,759,543 | A | 8/1956 | Conti | |
| 4,019,719 | A | 4/1977 | Schuster et al. | |
| 4,027,580 | A * | 6/1977 | Sundin | 271/186 |
| 4,073,487 | A | 2/1978 | Schirrmeister et al. | |
| 4,310,152 | A * | 1/1982 | Mitzel | 271/309 |
| 4,466,605 | A * | 8/1984 | Leuthold et al. | 271/177 |
| 4,834,361 | A * | 5/1989 | Fenske et al. | 271/309 |
| 7,431,288 | B2 * | 10/2008 | Shmaiser et al. | 271/186 |
| 2005/0280198 | A1 * | 12/2005 | Laluk et al. | 271/94 |

FOREIGN PATENT DOCUMENTS

| | | |
|---|---|---|
| DE | 2909833 | 9/1980 |
| DE | 10338598 | 8/2003 |
| EP | 0673868 | 1/1999 |
| GB | 2103587 | 2/1983 |
| GB | 2273489 | 6/1994 |
| WO | WO2004/069710 | 8/2004 |

* cited by examiner

*Primary Examiner* — Gerald McClain
(74) *Attorney, Agent, or Firm* — Christopher J. White

(57) ABSTRACT

The invention relates to a device for depositing sheets for a printing machine, preferably for an electrophotographically operating printing machine, said device comprising at least one sheet transport member which can be driven so as to rotate and which is provided for the detection of a lead edge of a sheet and for depositing the sheet after it has covered a rotating path.

12 Claims, 12 Drawing Sheets

DEVICE FOR DEPOSITING FOR A PRINTING MACHINE WITH A BLOWER SYSTEM

FIELD OF THE INVENTION

The invention relates to a device for depositing sheets for a printing machine, preferably for an electrophotographically operating printing machine, said device comprising at least one sheet transport member which can be driven so as to rotate and which is provided for the detection of a lead edge of a sheet and for depositing the sheet after it has covered a rotating path.

BACKGROUND OF THE INVENTION

Previous sheet deposition devices have already been suggested by prior German Patent Applications DE 103 38 596.7 and the international patent application WO 2005 019076 based on the German priority application DE 103 38 597.5, these being considered here with express reference to their disclosure. Basically, however, rotating depositing systems have also been known otherwise.

U.S. Pat. No. 4,027,580 discloses a device suitable for depositing sheets comprising at least one sheet transport member which can be driven so as to rotate and which is provided for depositing the sheet after it has covered a rotating path wherein the device comprises a blower arrangement for the application of air to the sheet to be deposited, wherein the sheet is detected by detection means.

Namely in the area of money printing machines they are known as well, e.g., from document U.S. Pat. No. 4,431,178.

Money bills, in particular, are relatively small in size and relatively stiff, so that rotating depositing systems can be used for very rapid and precise work. Therefore, such systems are suitable in this field also for handling large volumes. However, such rotating depositing systems can create problems when relatively large printing sheets are processed, i.e., already in the range of sizes such as DIN A4, i.e., sheets having a length of approximately 30 cm, especially if their weight is relatively low, i.e., if the sheets are relatively thin. For example, it is difficult to process sheets having a size such as DIN A3 and a low sheet weight of approximately 80 grams per square meter with rotating depositing systems, specifically at low rotational speeds which result, for example, in a transport speed of 300 millimeters per second or less.

Referring to the aforementioned sheet transport member, the sheet will be grasped at its lead edge and then carried along for approximately half a rotation of the sheet transport member, transported against a stack abutment and then dropped for deposit. Due to the transport momentum, the rear, released portion of the sheet is to double over in a whip-like manner due to the inherent stiffness of the sheet, so that the entire sheet is rolled over toward its tray. If, however, a large thin sheet is transported and turned over relatively slowly in this way, the transport momentum and the inherent stiffness of the sheet might not be adequate to completely turn over the sheet, or to have it unroll; instead, the sheet collapses within itself in a pocket-like manner just like an omelet. In this case, of course, it is no longer possible to form a neat stack.

Therefore, the object of the invention is to make depositing a sheet and turning over a sheet, in particular also larger and/or thinner sheets, more reliable with the use of a device of the aforementioned type.

SUMMARY OF THE INVENTION

The invention relates to a device for depositing sheets for a printing machine, preferably for an electrophotographically operating printing machine, said device comprising at least one sheet transport member which can be driven so as to rotate and which is provided for the detection of a lead edge of a sheet and for depositing the sheet after it has covered a rotating path.

Therefore, the object of the invention is to make depositing a sheet and turning over a sheet, in particular also larger and/or thinner sheets, more reliable with the use of a device of the aforementioned type.

In accordance with the invention, this object is achieved by a device which is characterized by a blower arrangement for the application of air to the sheet to be deposited.

Due to the application of air, the sheet to be deposited and to be turned over is advantageously supported by an additional momentum and by its inherent stiffness, so that the sheet will unroll fully after its lead edge has been caught by the rotation.

DETAILED DESCRIPTION OF THE INVENTION

Figure 1:
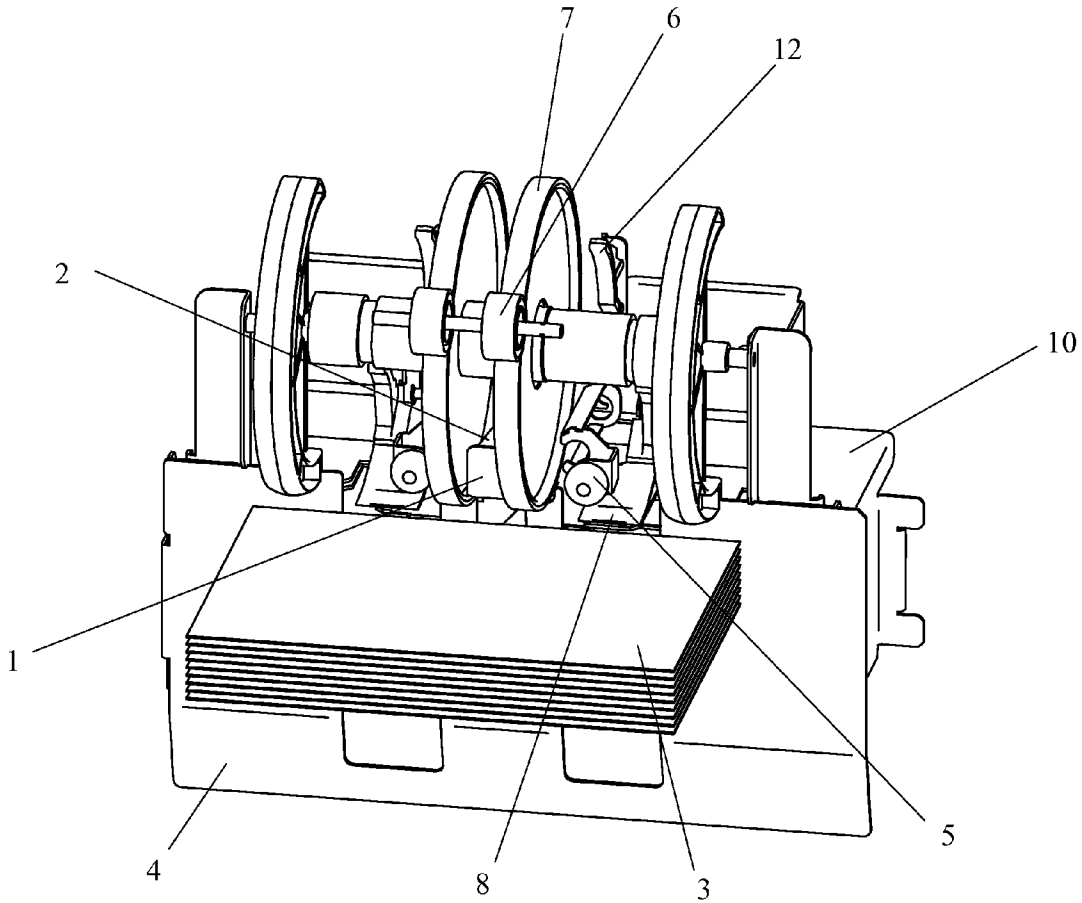
FIG. 1 shows a perspective view of a sheet deposition device of the present invention.

In accordance with the invention, this object is achieved by a device which is characterized by a blower arrangement for the application of air to the sheet to be deposited.

Due to the application of air, the sheet to be deposited and to be turned over is advantageously supported by an additional momentum and by its inherent stiffness, so that the sheet will unroll fully after its lead edge has been caught by the rotation.

This inventive application of air is particularly effective when, as provided by a modification of the invention, a current of air is directed into the curvature of the sheet guided along the path of rotation, whereby, however, the air current is preferably provided for application to the sheet end that is closer to the trailing edge of the sheet.

Preferably, an air channel is provided for generating and directing the air current, whereby the application of air is preferably achieved in a particularly effective manner by means of a radial fan.

In accordance with another modification of the inventive device, the accommodation, positioning and targeted alignment of an air current of the inventive blower arrangement are aided in that at least two coaxially rotatable cooperating sheet transport members are provided, the first sheet transport member essentially pre-specifying the path of curvature for the sheet to be transported by means of a generated surface acting as a support for the sheet, and the second sheet transport member having at least one overlap element entraining the accepted lead edge of the sheet, in such a manner that the lead edge of the sheet can be grasped and taken along between the overlap element and the generated surface. Preferably the first sheet transport member has essentially the shape of a disk or wheel and the second sheet transport member is essentially configured as a two-arm pivot rod comprising, respectively, one overlap element in the region of its radially outward pointing free ends. The overlap element is essentially configured as a tongue or tab following the path of curvature of the first sheet transport member in an approximately parallel manner.

Another modification of the invention is characterized in that, respectively, two first and at least two second coaxial sheet transport members are provided, said transport members being arranged on a joint axis in a mirror-symmetric manner such that the two second sheet transport members are located between the two first sheet transport members, so that a lead edge of the sheet can be grasped, during its travel parallel to the joint axis of the sheet transport members, by the total of four sheet transport members together. This, preferably, permits the application of air essentially approximately in the region of the plane of symmetry of the sheet transport members, this being particularly effective there, and that the blower arrangement can be installed there without any major retrofitting of the device.

Some additional stiffening of the sheet to be deposited is achieved preferably in that the side of the overlap elements of the second sheet transport members facing the sheet are at a radially smaller distance from the joint axis than the overlapped exterior side of the sheet applying its thickness to the radius of the generated surfaces of the first sheet transport members, so that, in its travel, the lead edge of the sheet is forced and bent slightly into the direction of the joint axis in a tension-generating manner in the region of the overlap elements.

As already mentioned above, to create an aligned stack of sheets, the sheet transport members preferably cooperate with a stack edge.

Another modification of the invention provides that several, preferably two, of each of the second sheet transport members are provided in such a manner that these multiple second sheet transport members can rotate essentially independently of each other about their joint axis and, in so doing, one of these second sheet transport members is ready to accept or grasp a subsequent sheet if another of these second sheet transport members is still busy with the transport or the depositing of a previous sheet. In this way, the inventive device can be accelerated to operate at approximately double the output rate.

Another modification of the invention provides that the application of air can be controlled by on/off-switching, interruption and/or deflection. Preferably, the additional application of air is required closer toward the end of the depositing operation when the lead edge of the sheet grasped by the sheet transport members has already come into abutment with a stack edge, when a bent large sheet still follows the sheet transport members, and when the trailing edge end of the sheet is just being released by the last transport rollers of a printing material path. Then the sheet transport and sheet turn-over will initially not be disrupted by the air, but the depositing operation is only finished with the aid of the air. During this process, the air, for example, enters the last rear sheet bay and then moves in a smoothing manner past the sheet that is unrolling due to resultant air pressure in the direction of said sheet's trailing edge. To achieve a chronological coordination, the air current may be controlled accordingly and, in this case, there are basically several options to achieve this, namely, the blower can be switched on and off, the air current can be interrupted by a vent flap or the like, or the air current can be deflected out of its operative region into a type of "air sink" if the air is not needed or would even be a problem. Considering these options, switching the blower would probably be the worst option, because the blower requires time for startups, and the switching operations could reduce the blower's useful life. In contrast, a basically continuous air current that is directed and/or interrupted is more favorable. The control may preferably be clocked by clocking one operating cycle of the sheet transport.

A preferred embodiment of the inventive device provides that the control element used is an element that is already being used in the device. Advantageously, this allows a particularly simple retrofitting or modernizing of an inventive device. Preferably, such a control element is a stack height feeler. In particular, the inventive device is characterized by a sensor arrangement for detecting the reached stack height or the reached stack level, said sensor arrangement comprising the stack height feeler acting, at the same time, as a sheet stack depressor, said stack height feeler being mechanically controlled to lift off the sheet stack in order to clear the sheet stack to allow depositing of the next sheet on the stack of sheets.

Preferably, the stack height feeler is mechanically coupled with the sheet transport members, which may be the case, for example, in that the stack height feeler is coupled with the sheet transport members by means of guide rockers. Preferably, a plurality of stack height feelers are arranged across the stack width, as has already been suggest by the earlier German Patent Application DE 103 38 598.3. Preferably, three stack height feelers are provided, one of which being arranged in the middle of the stack and the other two being arranged at a distance from one side and the other side of the centrally arranged stack height feeler, in which case, preferably, the central stack height feeler is provided as the control element. This matches a preferred arrangement of an air channel on the plane of symmetry of the device. In order to make the stack height feeler suitable as a vent flap for such an air channel, said stack height feeler is modified, if necessary, in that the dimensions of the stack height feeler are such that it can block or screen an air channel, specifically said stack height feeler is enlarged compared with its usual configuration, for example, said stack height feeler is provided with a sheet metal tab.

Referring to large sheets in particular, at least one guide element blocking a grasped sheet at least in centrifugal direction, for example a pressure roller, can be provided between the point where the sheet is grasped and the point where the sheet is released, in order to force the radius of curvature of the sheet to be maintained, in which case then, preferably, the air is applied only when the end of the sheet has left this guide element.

A further modification of the invention is characterized in that at least two air outlet nozzles are provided at different heights. In particular, the upper air outlet nozzle can be switched off earlier than the lower air outlet nozzle, so that the application of air is consistent with the progression of depositing and rolling-out the respective sheet. This is advantageous, in particular, when the sheet is to be folded over with the aid of the respective jet pressure of the nozzles. If, in contrast, first and foremost an air volume is to be built up, it is helpful if, as provided by another modification of the invention, if a guide element blocking a grasped sheet, at least in centrifugal direction, is provided between a grasping location and a depositing location of the sheet in order to force the radius of curvature to be maintained by the sheet, which is particularly important and useful when longer sheet formats are used. All the nozzles can then be used to puff up the curved sheet, and the upper air outlet nozzle is switched off, preferably at a time after which the trailing edge of the grasped sheet has left the guide element that blocks the sheet in centrifugal direction.

Another modification of the invention provides that one or more cascades of air outlet nozzles be provided, in particular, when the operation is to take place with an adequate air volume and with less directed pressurized air jets.

One embodiment of the inventive device could provide that, in order to form a cascade of air outlet nozzles, an air line following a curved path has a number of air outlet nozzle openings. Advantageously, in order to form the air line, a sheet transport member having the shape of a disk or a wheel or the shape of a disk segment or a wheel segment is designed at least partially hollow, said sheet transport member being already present, in order to impart the desired curvature and in order to act as an abutment for the respective sheet.

The drawings show embodiments which can also result in additional inventive features, which, however, do not restrict the scope of this invention.

They show in

Figure 2:
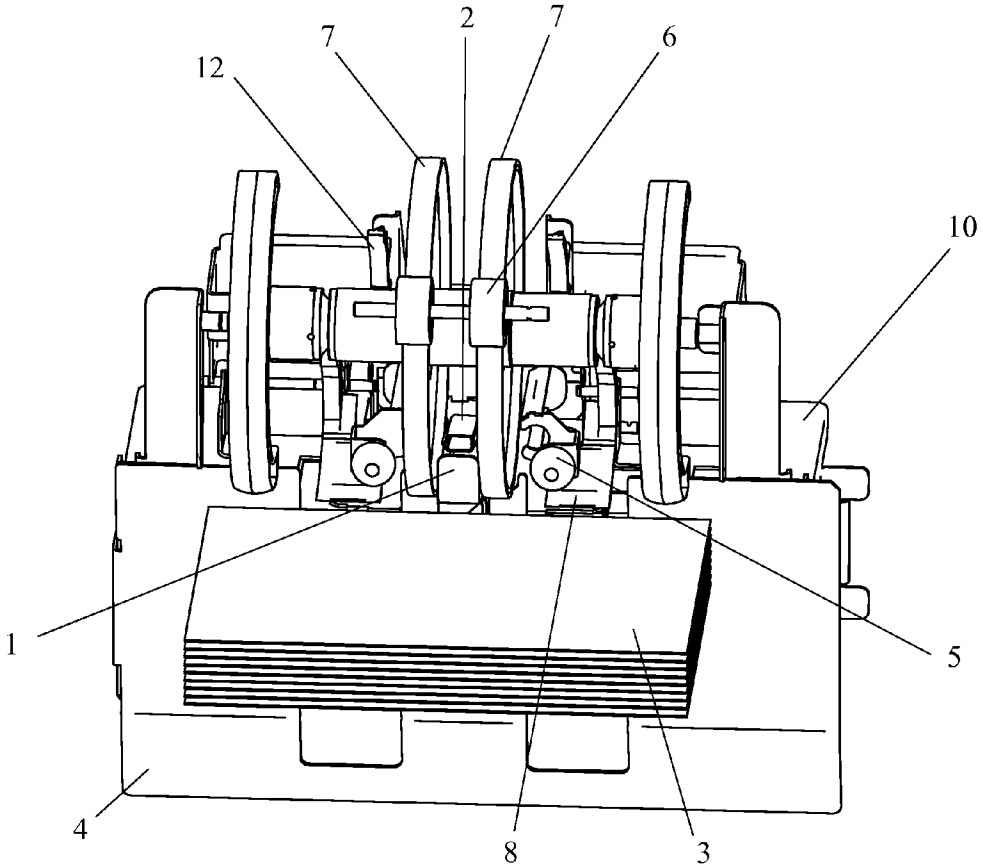
FIG. 2 shows another view of the sheet deposition device.
Figure 3:
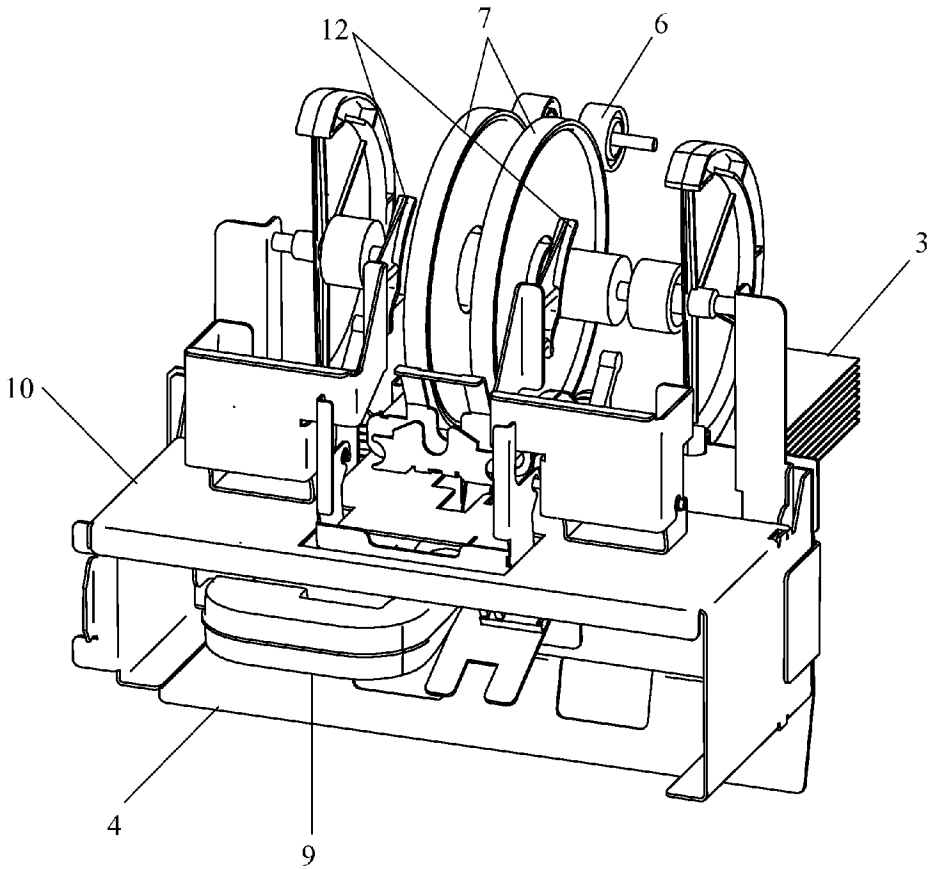
FIG. 3 shows the rear perspective view of the sheet deposition device.
Figure 4:
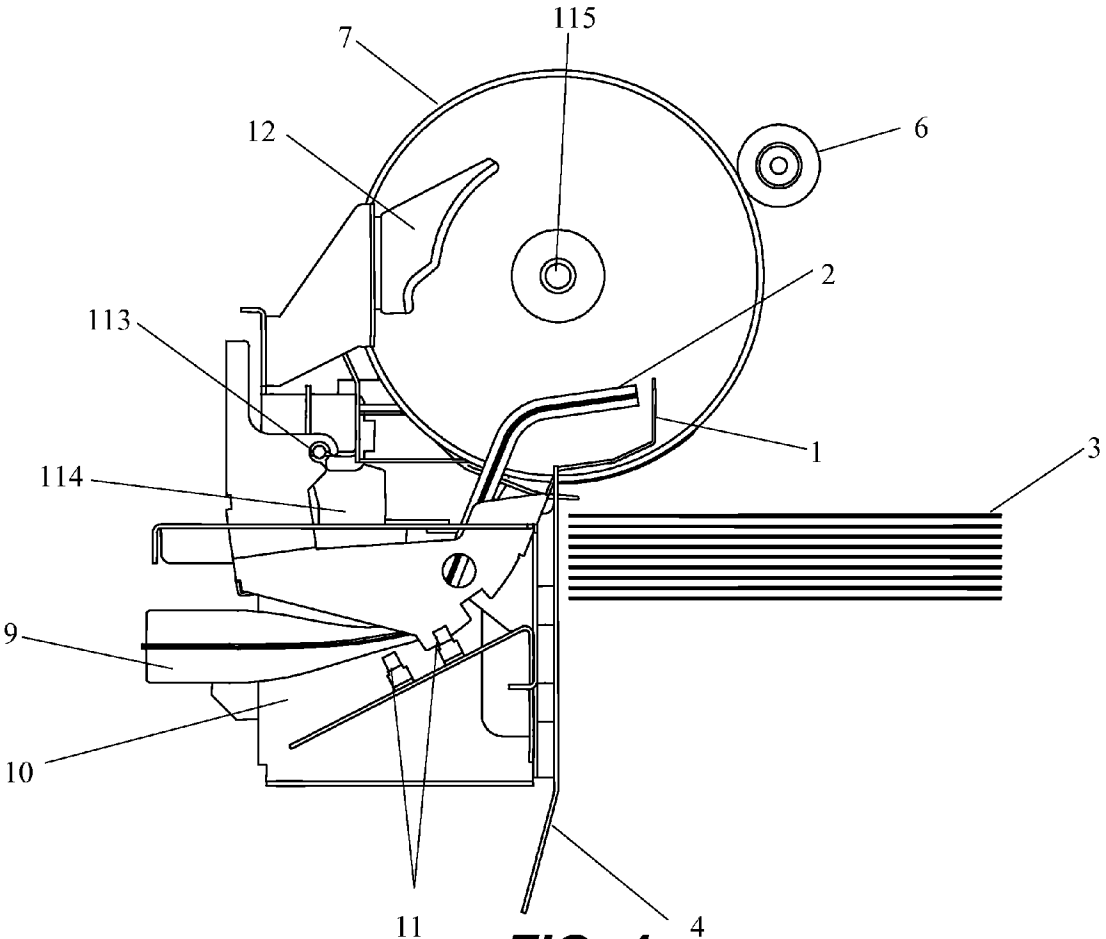
FIG. 4 shows the side elevation of the sheet deposition device.
Figure 5:
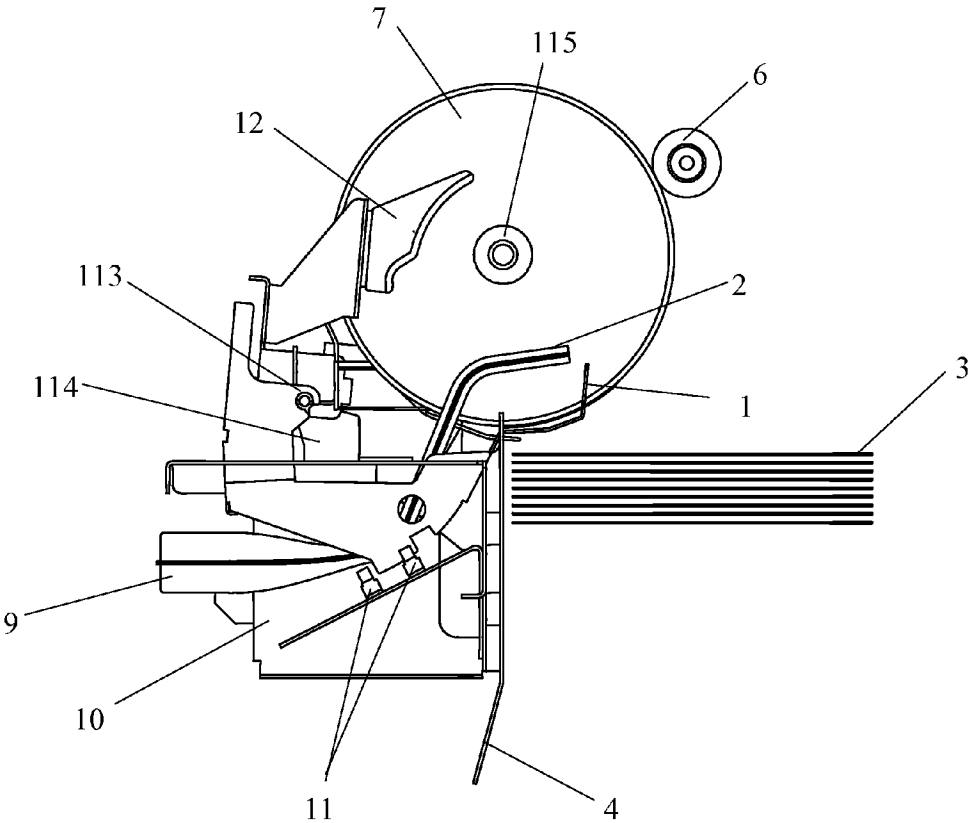
FIG. 5 shows another view of the sheet deposition device.
Figure 6:
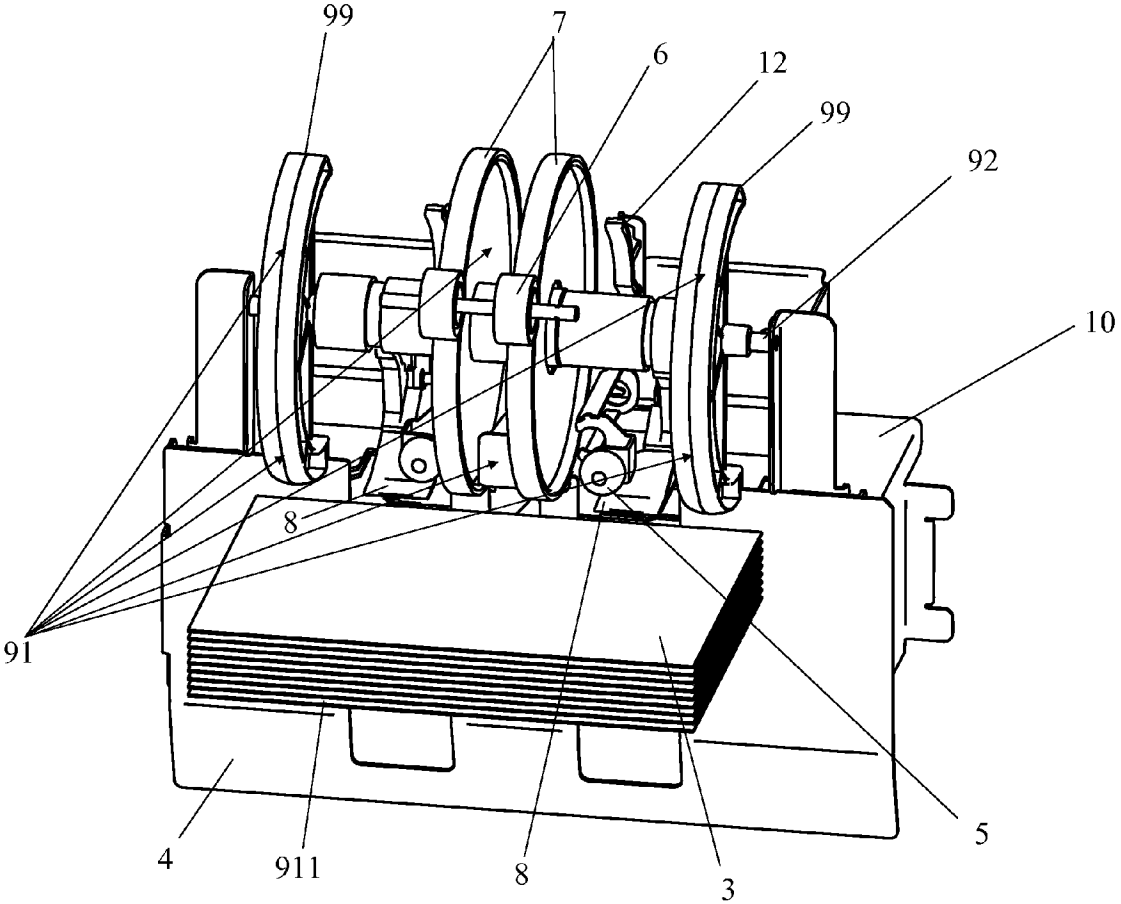
FIG. 6 shows the perspective view of a portion of another embodiment of the sheet deposition device.
Figure 7:
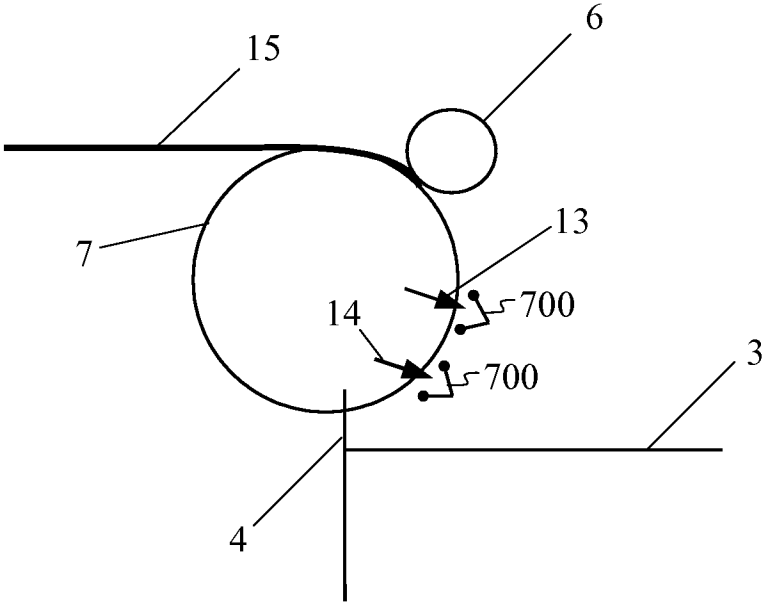
FIG. 7 shows a schematic side elevation of some elements of the embodiment shown in FIG. 6.
Figure 8:
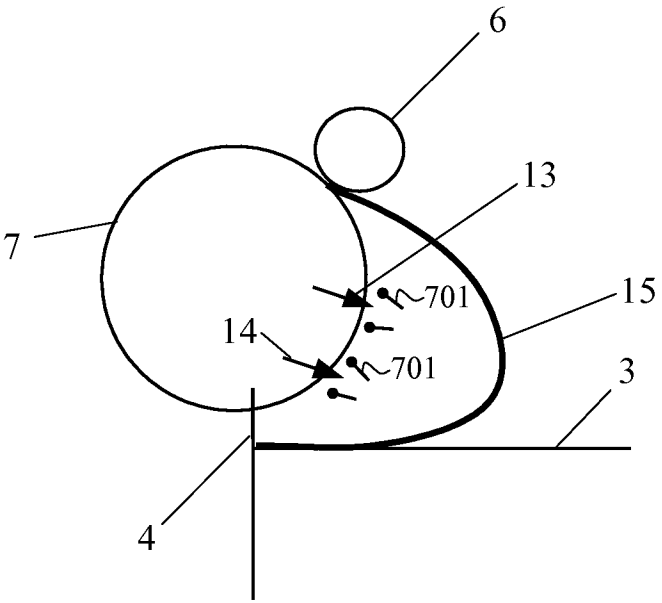
FIG. 8 shows another side elevation of the embodiment shown in FIG. 6.
Figure 9:
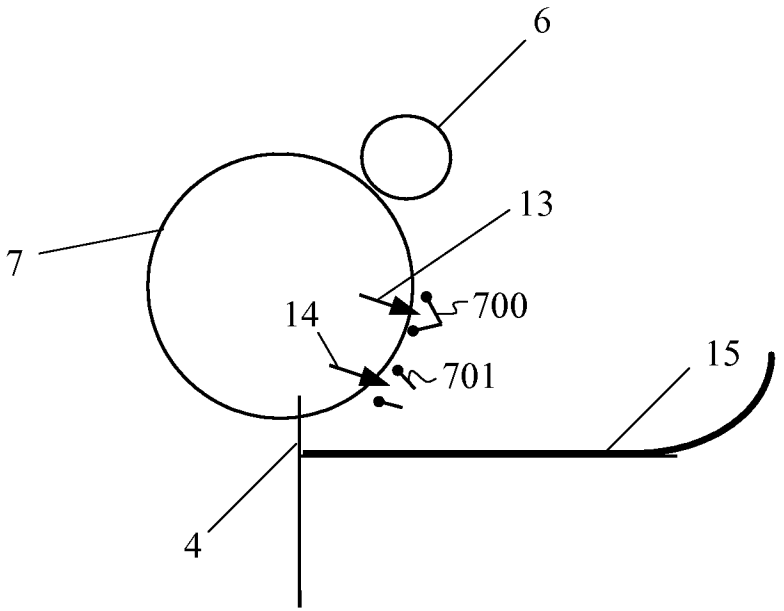
FIG. 9 shows another side elevation of the embodiment shown in FIG. 6.
Figure 10:
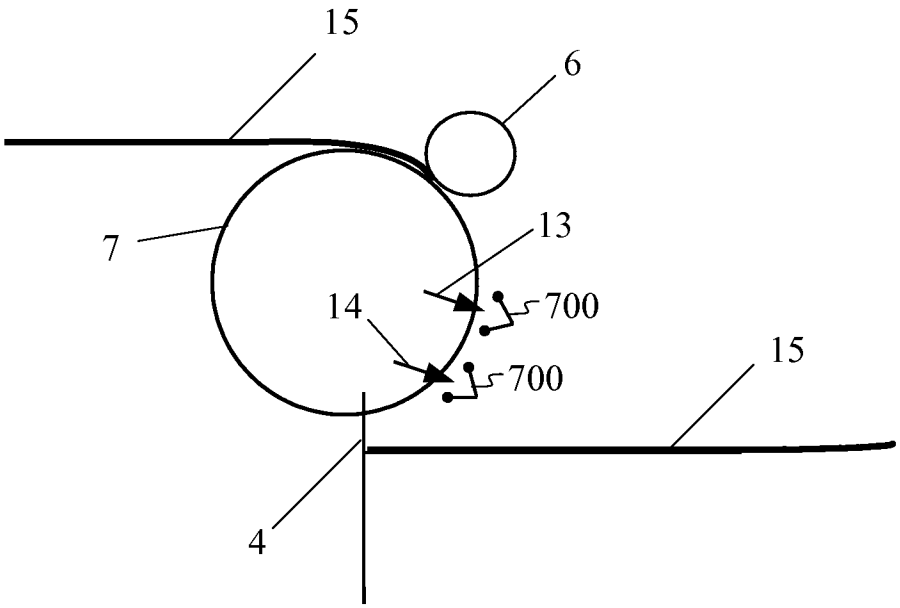
FIG. 10 shows another side elevation of the embodiment shown in FIG. 6.
Figure 11:
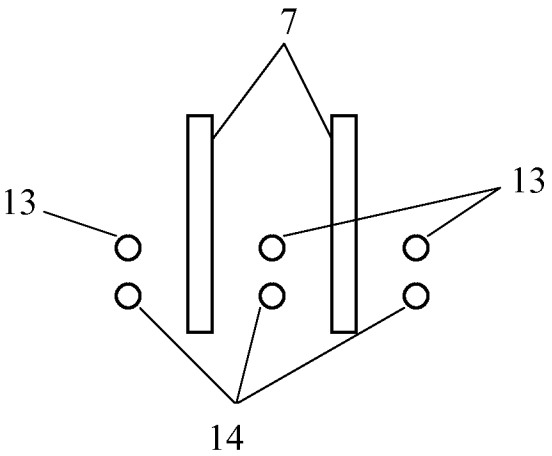
FIG. 11 shows a schematic front elevation of the sheet deposition device of the present invention.
Figure 12:
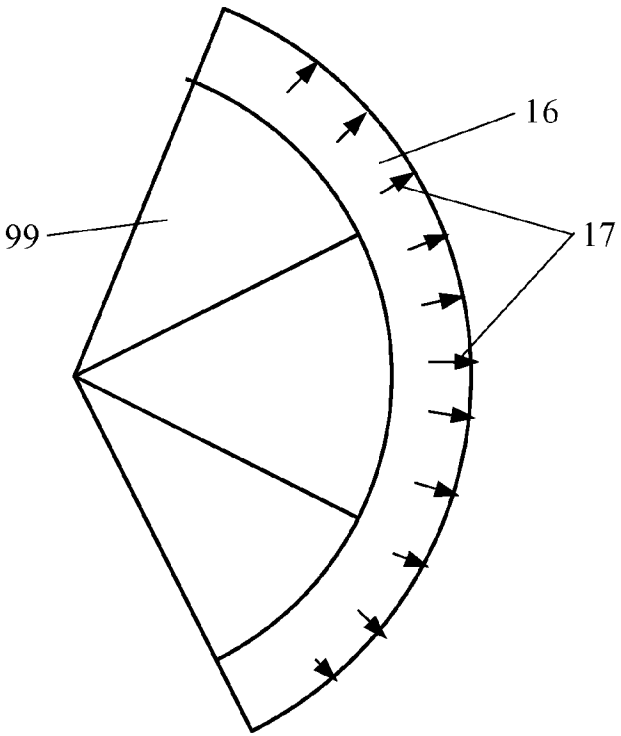
FIG. 12 shows a another embodiment of the sheet deposition device.

FIG. 1 a perspective view of an inventive device from the direction of a deposited stack of sheets, with the air channel closed;

FIG. 2 a view of the device as in FIG. 1, with the air channel opened;

FIG. 3 a rear perspective view of the device as in FIG. 1, facing away from the stack of sheets;

FIG. 4 a side elevation of the device as in FIG. 1, with the air channel closed; and, FIG. 5 a side elevation of the device as in FIG. 1, with the air channel opened;

FIG. 6 a perspective view of a part of another embodiment of an inventive device quite similar as in FIG. 1;

FIG. 7 a schematic side elevation of some elements of the device as in FIG. 6, showing a sheet at the time when it is grasped by a sheet transport member;

FIG. 8 the side elevation as in FIG. 7, after the lead edge of the sheet has abutted against a stack abutment;

FIG. 9 the side elevation as in FIG. 7, after the sheet has been placed on a stack;

FIG. 10 the side elevation as in FIG. 7, after the sheet has fully rolled out on the stack;

FIG. 11 a schematic front elevation of sheet transport members where potential locations of air outlet nozzles are indicated; and, FIG. 12 a potential embodiment of a nozzle cascade, in a schematic side elevation.

FIG. 1 shows a perspective view of an inventive device from the direction of a deposited stack of sheets with the air channel closed. FIG. 4 shows an additional side elevation thereof.

The inventive device comprises a frame 10, which accommodates, in particular, rotating first and second sheet transport members 7, 8, which are arranged on a joint axis 115 in a mirror-symmetric manner. These sheet transport members 7, 8 deposit arriving sheets, the arrival of which is detected by sensors 11, on a stack 3 of sheets. In so doing, the sheets are transported against a stack abutment 4 and, if necessary or desired, shifted cross-track by rollers 5. In an intermediate region, pressure rollers 6 additionally hold and guide the sheets on sheet transport members 7. Each time, the respective height of the stack of sheets is detected by stack height feelers. Referring to the inventive device, special attention is paid to the central stack height feeler 1, which can be pivoted up and down on a holder 115 about a pivot point 113. To achieve this, said stack height feeler is guided on a guide rocker 12, by means of which said feeler is coupled with the sheet transport members and controlled or clocked with respect to their movement cycle.

The central region of symmetry of the inventive device, i.e., the region of movement of the central stack height feeler 1, comprises a radial vent 9 with an air exit channel 2, which can be used to apply air to the sheets to be deposited in order to aid the depositing operation.

FIGS. 2 and 5 are perspective views of an inventive device, from the direction of the deposited stack 3 of sheets, and a side elevation as in FIGS. 1 and 4, with the air exit channel 2 opened. In addition, FIG. 3 is a perspective view of the rear side of the device, facing away from stack 3 of sheets.

The illustrated embodiment of an inventive device can operate as follows:

After a sheet to be deposited has been transported along a not specifically illustrated printing material path to the rotating depositing system in accordance with the invention, a not specifically illustrated sensor—which may be located in the region of the end of the printing material path—emits a signal to the depositing system to start the depositing operation.

To do so, a pair of second sheet transport members 8 begins to rotate. At the same time, the sheet to be deposited also enters between said second sheet transport members 8. The second sheet transport members 8, in so doing, also act as external sheet guides. The non-driven rotating first sheet transport members 7 act as internal sheet guides.

After the lead edge of the sheet has entered between the second sheet transport member pair 8 and said second sheet transport members 8 and the sheet have reached the same velocity, the second sheet transport members 8 and the sheet move in the direction of stack abutment 4. As soon as the sheet has reached stack abutment 4, the second sheet transport members 8 move through this stack abutment 4 and, in so doing, release the sheet in that the sheet is taken by stack abutment 4 out of sheet transport members 8, so that the sheet may drop onto stack 3 of sheets. The second sheet transport members 8, in turn, continue their movement back again into their upper sheet-receiving position, in which they can then receive and pick up the next sheet to be deposited.

While the lead edge of the sheet has already come into abutment with stack abutment 4 and thus has been stopped to a velocity of zero, the trailing edge of the sheet initially continues at full transport speed. If the sheet is long enough, this is achieved by a not specifically illustrated pair of transport rollers at the end of the printing material path and/or by the combination of pressure rollers 6 and the first sheet transport members 7.

At some time, however, also the trailing edge of the sheet leaves the aforementioned transport members. Thereafter, due to the inherent stiffness of the sheet and the imparted motion energy, the trailing edge of the sheet should bounce up diagonally in transport direction and describe a downward curve, and, as a result of this, the sheet should flatten out and drop on stack 3 of sheets. Considering greater sheet weights (starting at approximately 90 grams per square meter), this is achieved in the same manner, in particular when the transport speed is also high enough (approximately 300 to 320 millimeters per second or 309±approximately 10 millimeters per second).

However, problems may occur with lower sheet weights, in particular, weights less than or equal to 80 grams per square meter; this is especially the case when, in addition, these sheet formats are relatively large such as DIN A3 or DIN A3+. With such combinations, the trailing edge of the sheet does not bounce diagonally up in transport direction but drops perpendicularly downward. In so doing, the trailing edge of the sheet may fall onto the lead edge of the sheet, and the sheet comes to lie folded or folded down on the stack of sheets. The inventive blower arrangement can remedy this situation.

Air exit channel 2 directs an air current centered between the first and the second sheet transport members 7, 8 at the sheet to be deposited. The radial vent 9 provided therefor is located off-center below the rotating depositing system.

In order for the application of air to the sheet to occur at all times during the correct phase of the depositing operation and not require for the radial vent 9 to be switched on and off repeatedly—which would mean that each new setup of the air current would take up much time and which would considerably restrict the useful life and reliability of radial vent 9—the air current is run continuously and screened and/or deflected, if it is not needed or would be disruptive, and is always cleared when it is needed. Particularly advantageously, this is achieved by means of the central stack height feeler 1, which is optionally modified for this purpose, for example, provided with a supplementary tab, but is basically already provided. As a result of this, in particular, it is avoided that also the lead edge of the sheet and the central area of the sheet are unfavorably grasped by the air current. Otherwise, the sheet, which is only deflected but not held by the second sheet transport members 8, would be lifted or tilted by the air current out of the second sheet transport members 8. This lifting would be additionally unfavorably intensified by the curved shape of the sheet that has been forcibly imparted on the sheet by the first sheet transport members 7. As a result of this, the sheets would at least arrive skewed or offset on the stack 3 of sheets, which is to be avoided. Instead, air is only applied to the sheet at a later time when the air current is still directed only at the rear sheet area that has already cleared the transport members, said sheet area still being upwardly curved—before the trailing edge of said sheet could move perpendicularly downward—and thus being only unrolled by the air current and not being blown off track. The particular advantage of the use of the central stack height feeler 1 for this purpose is not only that said stack height feeler is already physically present but, in particular, that stack height feeler 1 already is provided with exactly the right control system for the described air application process, i.e., configured as a guide rocker 12.

During the depositing operation, stack height feeler 1 assumes two extreme positions, i.e., an upper position (FIG. 4), when a sheet to be newly deposited must be freely transported by its lead edge to stack abutment 4, and a lower position (FIG. 5), in which said feeler is to sense the height level reached by the sheet tray by means of sensors 11. This movement of stack height feeler 1, as can be seen in FIGS. 4 and 5, is also used to cover and clear air exit channel 2.

In order to completely cover the exit opening of air exit channel 2, only a sheet metal tab enlargement is provided on stack height feeler 1. By covering this exit opening of air exit channel 2, this air exit opening is not sealed hermetically, but the exiting air is deflected mainly backward into the internal mechanics of the depositing system. The lead edge and the central area of the sheet that is just to be deposited can then be moved initially unimpaired in the direction of stack abutment 4.

Once the lead edge of the sheet has reached stack abutment 4 and the trailing edge of the sheet leaves the last transport engagement, the central stack height feeler 1 moves rapidly downward. In so doing, the sheet to be deposited is pressed onto the stack 3 of sheets, and air exit channel 2 is cleared and the air current is directed directly at the rear sheet area. In so doing, the trailing edge of the sheet is flipped over, as desired, and the sheet is deposited flat and correctly aligned in the correct position on the stack 3 of sheets.

Before the lead edge of the next sheet is transported to stack abutment 4, the stack height feeler 1 lifts off in time and, in so doing, again covers the air exit channel 2 in order to ensure an uninterrupted transport of the next sheet, specifically said sheet's lead edge. This cycle of movements will be repeated from one sheet to the next.

FIG. 6 shows a perspective illustration quite similar as in FIG. 1 of a part of another embodiment of an inventive device. To avoid confusion, only very few elements of a depositing device for sheets are indicated, i.e., only enough to permit a rough spatial orientation.

The device comprises a type of base frame 10. Arranged on this base frame 10 are, among other things, a stack tray 911 and a stack abutment 4 for a stack 3 of deposited sheets. In order to determine the current height of the stack 3, not specifically illustrated height feelers are provided, said feelers performing a clocked up-and-down movement during each sheet-depositing operation and being guided on guide rockers 12. These feelers are coupled with sensors, which, depending on the determined height of the stack, adjust the height of stack tray 911 in such a manner that the upper side of stack 3 is always at the same level, even as stack 3 grows, so that the path for depositing the sheet is the same for each sheet.

Located on a shaft 92 are driven sheet transport members 7 and 8. First sheet transport members 7 have essentially the shape of a disk, and act as guide support and as curvature core for a sheet to be deposited. From the outside, the sheet to be deposited is held by overlap elements of the second sheet transport members 8, said overlap elements being configured as tabs; mostly only these tabs can be seen in FIG. 1. The second sheet transport members 8 are essentially configured as two-arm pivot rods comprising, respectively, one overlap element in the region of their radially outward pointing free ends. However, to avoid confusion, as already mentioned, this is not fully shown in the drawing. Two first and at least two second coaxial sheet transport members are provided, said transport members being arranged on a joint axis (along shaft 92) in a mirror-symmetric manner such that the lead edge of a sheet can be grasped during its travel parallel to the joint axis of the sheet transport members 7, 8, by the total of four sheet transport members 7, 8 together. Preferably, there are two independently rotatable second sheet transport members 8 for each first sheet transport member 7 in order to achieve a faster sheet depositing cycle. In addition, external sheet transport members 99, like the first sheet transport members 7, also act as curved abutment surfaces for the sheet to be deposited and help during the clamp-type grasping of the lead edge of the sheet as counter surface, and can also be viewed and addressed as first sheet transport members, or they can be replaced by first sheet transport members 7.

Located above the tabs of the second sheet transport members 8, there are rolls 5, which can be moved cross-track and which can be lowered to the sheet last deposited on stack 3 in order to temporarily press said sheet onto the stack and in order to shift it in transverse direction, if needed. In addition, during each sheet's deflection and turn about the first sheet transport member 7, the said grasped sheet is pressed against the first sheet transport members 7 by pressure rollers 6. This is of consequence in particular when long-format sheets are used.

The overview of FIG. 6 has arrows 91 now indicating locations at which inventive air outlet nozzles of this second embodiment of an inventive device can preferably be arranged in order to help place each grasped sheet flat on stack 3. Preferably, air outlet nozzles 13, 14 are to be located approximately in the region of the sheet's center between the first sheet transport members 7 in two superimposed planes and, respectively, to the right and left of the first sheet transport members 7, in the region of the sheet edges. The front elevation of FIG. 11 indicates this again in a rough schematic.

FIGS. 7 through 10 show schematic cross-sections or side elevations of various chronological phases as a sheet 15 passes through the elements of the inventive device. To avoid confusion, these figures only indicate the contours of a first sheet transport member 7, a pressure roller 6, stack abutment 4 and stack 3, as well as air outlet nozzles 13 and 14 (as arrows).

FIG. 7 shows the phase of entry of a sheet 15 into the depositing device. During this entry, the lead edge of the sheet is clamped between the not-illustrated overlap elements of the second sheet transport members 8 and the circumference of the first sheet transport members 7, and, as rotation of the first sheet transport members 7 is started in clockwise direction as shown by FIG. 6, is also soon guided under pressure rollers 6 and additionally held by them. In this phase, air outlet nozzles 13, 14 could and should still be switched off, e.g., by being interrupted by closed vent flaps 700.

FIG. 8 shows the phase, in which the lead edge of sheet 15 already abuts against the stack abutment and said sheet's trailing edge—at least in the case of longer sheets 15—is still held by pressure rollers 6 against the first sheet transport members 7. At this point, rolls 5 for cross-track movement, which are not illustrated in FIGS. 7 through 5, can already press the lead edge of sheet 15 on stack 3. Now, at the latest, both air outlet nozzles 13, 14 are switched on in order to puff up sheet 15 like a sail, thus pushing or blowing said sheet in its depositing direction onto stack 3. As shown, vent flaps 701 in front of outlet nozzles 13, 14 are open.

FIG. 9 shows the trailing edge of sheet 15 released by pressure rollers 6. Sheet 15 has already largely rolled out on stack 3, and the upper air outlet nozzles 13 can or will be switched off. Vent flap 700 is closed to interrupt air current from upper air outlet nozzles 13.

FIG. 10 shows sheet 15 completely rolled out on stack 3, and now the lower air outlet nozzles 14 can or will also be switched off. Vent flaps 700 are closed to interrupt air current from air outlet nozzles 13, 14. Now, at the latest, the next sheet 15 can be received by the depositing device.

Air outlet nozzles 13, 14 are indicated with a slight downward inclination in order to aid depositing the sheet 15 on stack 3 due to more favorable vector conditions.

FIG. 12 shows a potential embodiment of a nozzle cascade in schematic side elevation. Such nozzle cascades can be integrated in the external sheet transport members 9, or similar elements may be provided therefor. A tire segment 16 of the sheet transport member 9 could be configured as an air line with a radial supply, and air outlet nozzle openings 17 could be provided in air line 16. Air outlet nozzle openings 17 are directed radially into the curvature of the sheet and can thus fill the sheet with an air volume. It is also conceivable to place curved tube-like air lines in appropriate intermediate spaces between sheet transport members 7 and 99 and to provide them with air outlet openings 17 in order to implement a design similar to that in FIG. 12.

The invention claimed is:

1. A device for depositing sheets for a printing machine, the device comprising:

at least two sheet transport members which can be driven so as to rotate in a rotating path and which are adapted to convey a sheet along a curved path, and to deposit the sheet after the sheet has passed along the curved path, and a blower system for the application of air to the sheet to be deposited, the blower system including a plurality of air nozzles, and adapted to selectively direct a current of air into a curvature of the sheet guided along the curved path, the sheet transport member comprising at least one guide element blocking the sheet at least in a centrifugal direction, the guide element located between the point where the sheet is grasped and the point where the sheet is released in order to force the radius of curvature of the sheet to be maintained, wherein the sheet transport member further comprises at least two air outlet nozzles provided at different heights, an upper air outlet nozzle and a lower air outlet nozzle, wherein the upper air outlet nozzle further comprises an operative device that is capable of switching the upper air outlet nozzle off earlier than the lower air outlet nozzle.

2. The device of claim 1, wherein the upper air outlet nozzle is switched off after the trailing edge of the grasped sheet has left the guide element that blocks the sheet in centrifugal direction.

3. The device of claim 1 wherein the sheet transport member further comprises one or more nozzle cascades, each cascade comprising one or more air outlet nozzles cooperating with an air line having a curved path.

4. The device of claim 1 wherein the sheet transport member further comprises a wheel comprising an air line for the air outlet nozzles, the air outlet nozzles located on the wheel and directed radially into the curvature of the sheet.

5. The device of claim 1 wherein the sheet transport member further comprises a wheel segment configured as an air line with an air supply line for the air outlet nozzles, the air outlet nozzles located on the wheel segment and directed radially into the curvature of the sheet.

6. The device of claim 1 wherein the sheet transport member further comprises a wheel having one or more curved tube-like spoke members comprising an air line for the air outlet nozzles, the air outlet nozzles located on the one or more curved tube-like spoke members and directed radially into the curvature of the sheet.

7. The device of claim 1 the sheet transport member further comprising a wheel segment having one or more curved tube-like spoke members comprising an air line for the air outlet nozzles, the air outlet nozzles located on the one or more curved tube-like spoke members and directed radially into the curvature of the sheet.

8. The device of claim 1 the sheet transport member further comprising the one or more air outlet nozzles located on a disk shaped member wherein the disk shaped member is at least partially hollow.

9. The device of claim 1 the sheet transport member further comprising the one or more air outlet nozzles located on a wheel-segment shaped member wherein the wheel-segment shaped member is at least partially hollow.

10. The apparatus according to claim 1, wherein the air outlet nozzles are inclined downward.

11. A method for depositing one or more sheets in a printing machine, the method comprising:

grasping at least one sheet in the printing machine;

after the grasping step, rotating at least one member of each of a plurality of sheet transport members which can be driven so as to rotate in a rotating path;

detecting a lead edge of the sheet using a sensor;

moving the sheet along a transport path before depositing the sheet after it has covered the rotating path and releasing the sheet;

further blowing the sheet using a blower system for the application of air to the sheet to be deposited, where a current of air is directed into a curvature of the sheet guided along the transport path, the blower system including a plurality of air nozzles, comprising at least one guide element;

blocking the sheet at least in a centrifugal direction using the guide element located between the point where the sheet is grasped and the point where the sheet is released in order to force the radius of curvature of the sheet to be maintained; and releasing the sheet, wherein the sheet transport member further comprises at least two air outlet nozzles provided at different heights, an upper air outlet nozzle and a lower air outlet nozzle, wherein the upper air outlet nozzle further comprises an operative device that is capable of switching the upper air outlet nozzle off earlier than the lower air outlet nozzle.

12. The apparatus according to claim 11, wherein the air nozzles are inclined downward.

* * * * *